US006538223B1

(12) United States Patent
Yoshida et al.

(10) Patent No.: US 6,538,223 B1
(45) Date of Patent: Mar. 25, 2003

(54) ELECTRIC TRANSFER SWITCH UNIT

(75) Inventors: Katsuhiro Yoshida, Sakahogi-machi (JP); Hisayuki Nagase, Nagoya (JP)

(73) Assignee: Kabushiki Kaisha ISE, Tokyo (JP)

( * ) Notice: Subject to any disclaimer, the term of this patent is extended or adjusted under 35 U.S.C. 154(b) by 0 days.

(21) Appl. No.: 10/054,886

(22) Filed: Jan. 25, 2002

(30) Foreign Application Priority Data

Oct. 15, 2001 (JP) ..... 2001-316554

(51) Int. Cl.[7] ..... H01H 23/00
(52) U.S. Cl. ..... 200/401; 200/1 R
(58) Field of Search ..... 200/1 V, 401, 200/33 P, 34, 416, 428, 459, 461, 1 R, 50, 32, 33, 573, 574

(56) References Cited

U.S. PATENT DOCUMENTS 817,719 A * 4/1906 Leonard ..... 318/278
3,668,354 A * 6/1972 Meermans ..... 200/504
4,034,170 A * 7/1977 Raabe et al. ..... 200/50.12
4,157,461 A * 6/1979 Wiktor ..... 200/18
4,590,387 A * 5/1986 Yoshida et al. ..... 307/64
4,791,255 A * 12/1988 Eliezer ..... 218/1
5,638,948 A * 6/1997 Sharaf et al. ..... 200/401
5,914,467 A * 6/1999 Jonas et al. ..... 200/1 R

* cited by examiner

*Primary Examiner*—Michael Friedhofer
*Assistant Examiner*—Lisa N Klaus
(74) *Attorney, Agent, or Firm*—Jacobson Holman PLLC

(57) ABSTRACT

An electric transfer switch unit for selective connection to different power supplies is provided with moveable contacts, associated stationary contacts connected to said power supplies, a turnable drive handle and a toggle mechanism for connecting the drive handle to the moveable contacts. The toggle mechanism includes a spring system adapted for storing and releasing mechanical energy upon turning of the drive handle. Use of the spring system assures swift and stable turning of the drive handle for shifting between the different power supplies.

13 Claims, 13 Drawing Sheets

ELECTRIC TRANSFER SWITCH UNIT

BACKGROUND OF THE INVENTION

The present invention relates to an electric transfer switch unit, and more particularly relates to an electric transfer switch unit provided with a two-position toggle mechanism for selective connection to different power supplies.

STATE OF THE ART

An electric transfer switch is used for selective connection between different power supplies. For example, an electric load is connected, via a transfer switch unit, to a normal power supply under normal conditions but connected to an emergency power supply in case of blackout due to earthquakes or floods, etc. On recovery of the normal power supply, the electric load is connected back to the normal power supply through shifting in position of the transfer switch.

In one type of the conventional electric transfer switch unit, a moveable contact is employed for selective contact with a plurality of stationary contacts and an energy storage mechanism such as a toggle mechanism is used for swift shifting of the moveable contact. After the moveable contact has performed shifting in position, the toggle mechanism locks the moveable contact for maintenance of contact with a selected stationary contact.

One example of such a transfer switch unit is disclosed in U.S. Pat. No. 4,590,387. All of the conventional transfer switch units of this type are, however, accompanied with lots of problems. First, the transfer switch units are in general much complicated in construction necessitating use of many mechanical elements. Second, due to use of many mechanical elements, they are relatively large in construction. Third, large distances between stationary contacts necessitate use of a circuit interrupter.

SUMMARY OF THE INVENTION

It is the primary object of the present invention to provide an electric transfer switch unit simple and compact in construction.

It is another object of the present invention to provide an electric transfer switch unit which assures reliable operation without need of a circuit interrupter.

It is the other object of the present invention to provide an electric transfer switch unit of low cost and adapted for easy assemblage.

In accordance with the present invention, an electric transfer switch unit is provided with a toggle mechanism for swift selective shifting between two different power supplies such as a normal power supply and an emergency power supply.

The toggle mechanism is used for a transfer switch unit including a moveable contact mounted to a rotatable crossbar. The moveable contact is able to shift between the first and second stationary contacts which are respectively connected to different power supplies such as a normal power supply and an emergency power supply. The toggle mechanism includes link arms for forming a pair of toggle linkages for driving the crossbar, extensible links and coil springs encircling respective extensible links. Mechanical energy for swift shifting operation is stored in the coil springs.

The toggle mechanism further includes a handle mounted to the crossbar. As the handle turns about the longitudinal axis of the crossbar, the crossbar and the toggle linkages are also driven for rotation for intended shifting in position of the transfer switch unit. The handle may be driven for turning by manual operation or by operation of a proper drive unit such as solenoids.

Turning of the handle causes compression of the pair of extensible links and the associated coil springs. Upon turning of the handle over a prescribed angle, the moveable contact is made to shift by rotation of the crossbar from a closed position with one stationary contact to a neutral open position. Thereafter, as one pivot of the extensible link traverses a straight line connecting both pivots of the extensible link to the longitudinal axis of the crossbar, the extensible links and the coil sprigs are extended and release stored energy for swift rotation of the crossbar. Next, the moveable contact carried by the crossbar shifts to the neutral open position to a closed position with the other stationary contact so that the moveable contact is brought into electric connection with the other stationary contact. Since a large distance is reserved between the moveable contact and the stationary contact for reliable insulation, no use of current interrupter is necessitated.

The coil springs store energy until one pivot of the extensible ling traverses the straight line connecting the both pivots of the extensible link and the longitudinal axis of the crossbar. Consequently, the handle is locked by the toggle linkages in order to inhibit separation of the moveable contact from the stationary contact. Thus, the toggle mechanism inhibits accidental separation for the moveable contact from the stationary contact due to possible application of mechanical or electric external forces.

In the closed position, the moveable contact is urged for reliable contact with the stationary contact thanks to operation of the coil springs.

DESCRIPTION OF THE PREFERRED EMBODIMENTS

The present invention shall be described in more detail in reference to the accompanying drawings. In FIGS. 1 to 4, the electric transfer switch unit 1 of the present invention includes a frame 2, a toggle mechanism 3 and a crossbar 4. The crossbar 4 is mounted to the frame 2 in a rotatable arrangement around its own longitudinal axis A—A.

Figure 1:
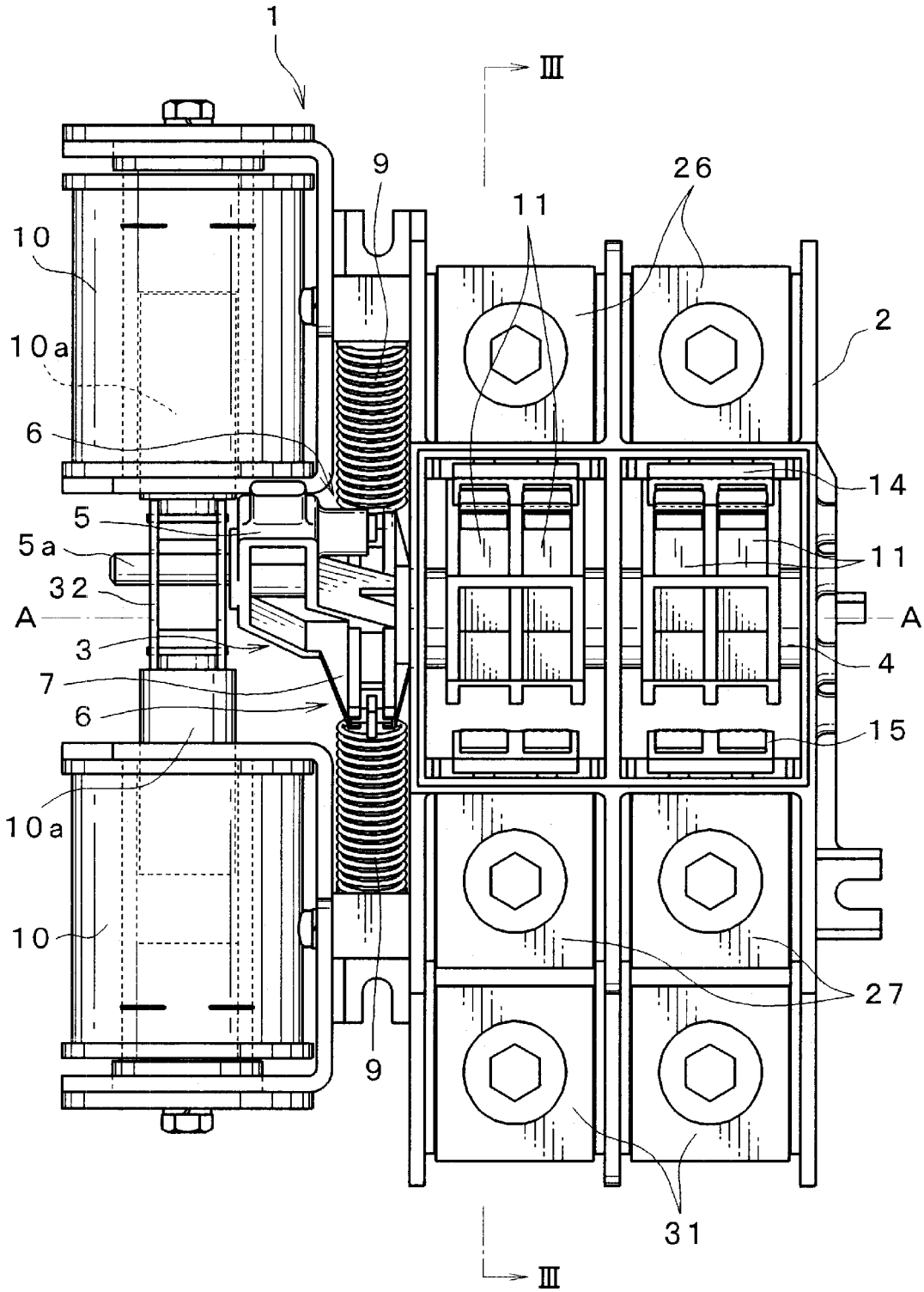
FIG. 1 is a plan view of the electric transfer switch unit provided with a toggle mechanism in accordance with the present invention.
Figure 2:
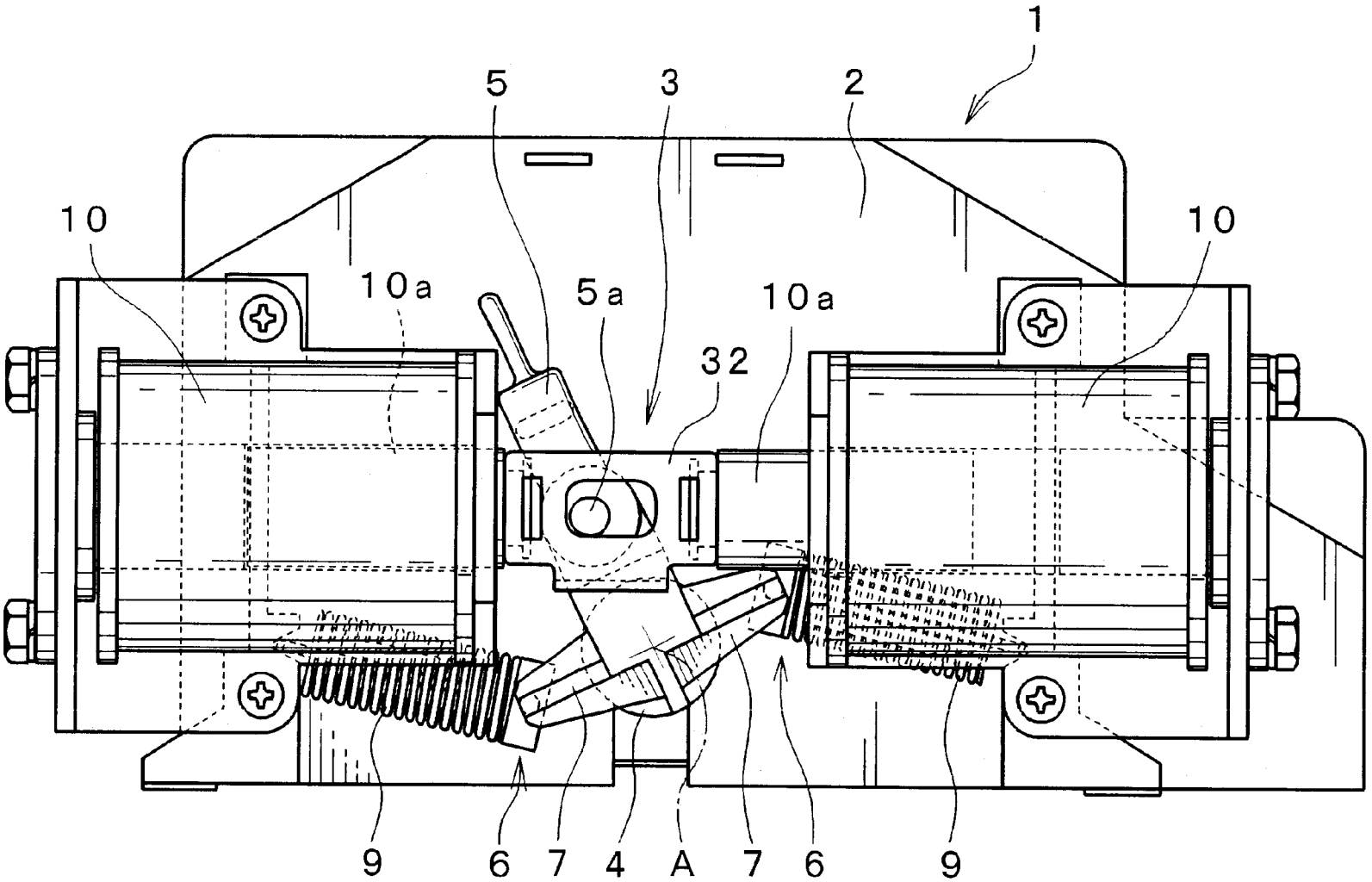
FIG. 2 is a side view of the electric transfer switch unit provided with a toggle mechanism in accordance with the present invention.
Figure 4:
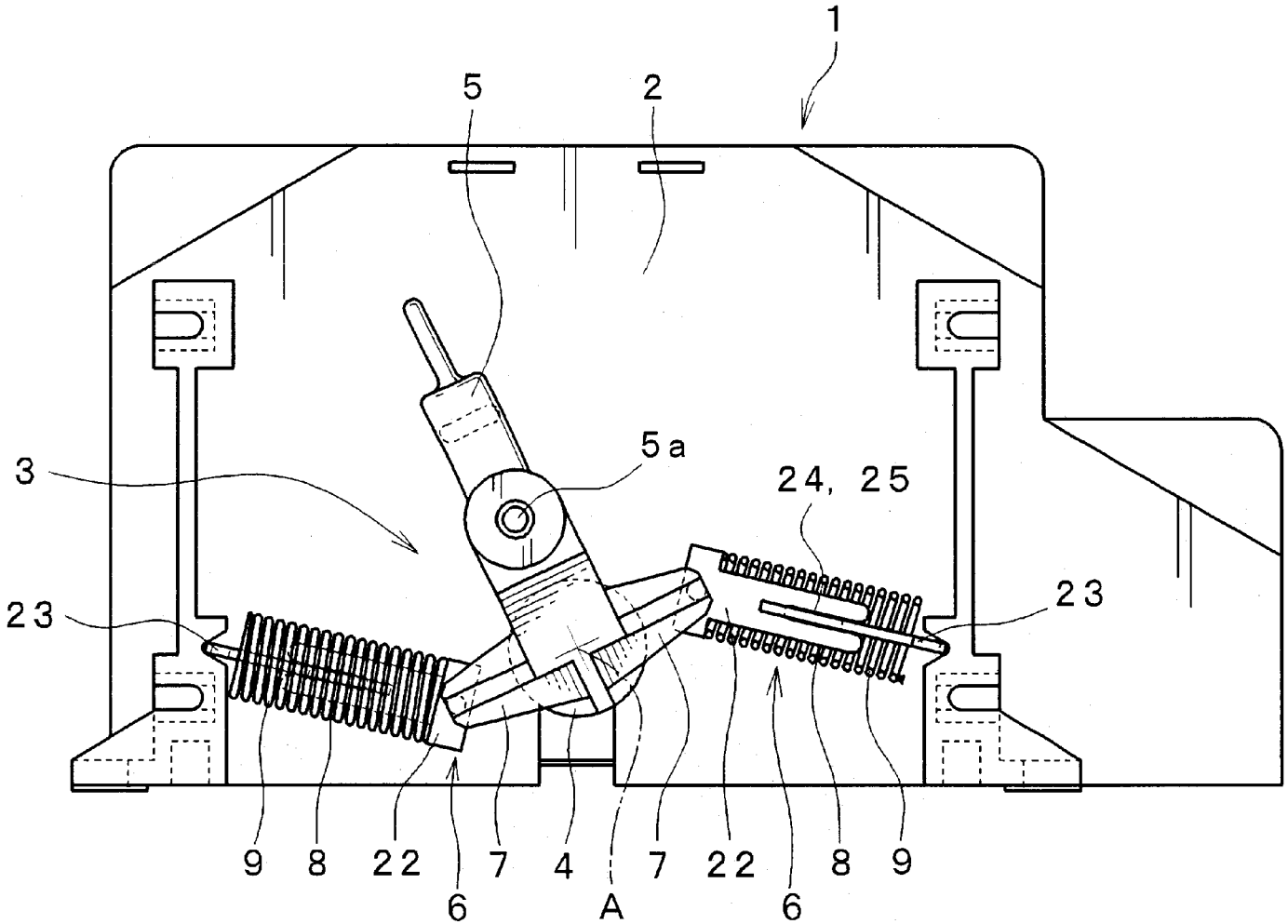
FIG. 4 is a side view of the transfer switch unit partly taken away for clear illustration.
Figure 5:
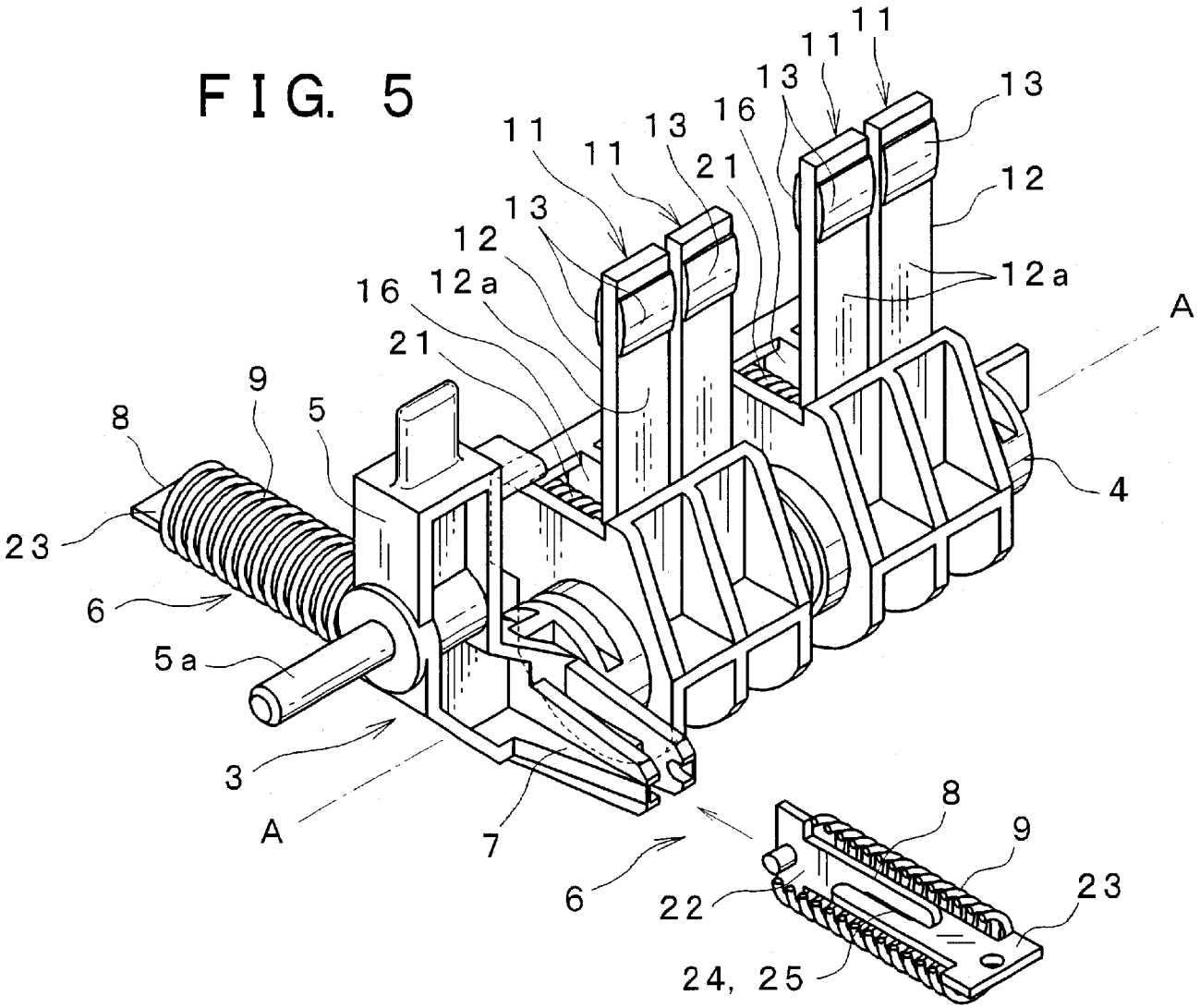
FIG. 5 is a perspective view of the toggle mechanism associated with a crossbar.
Figure 6:
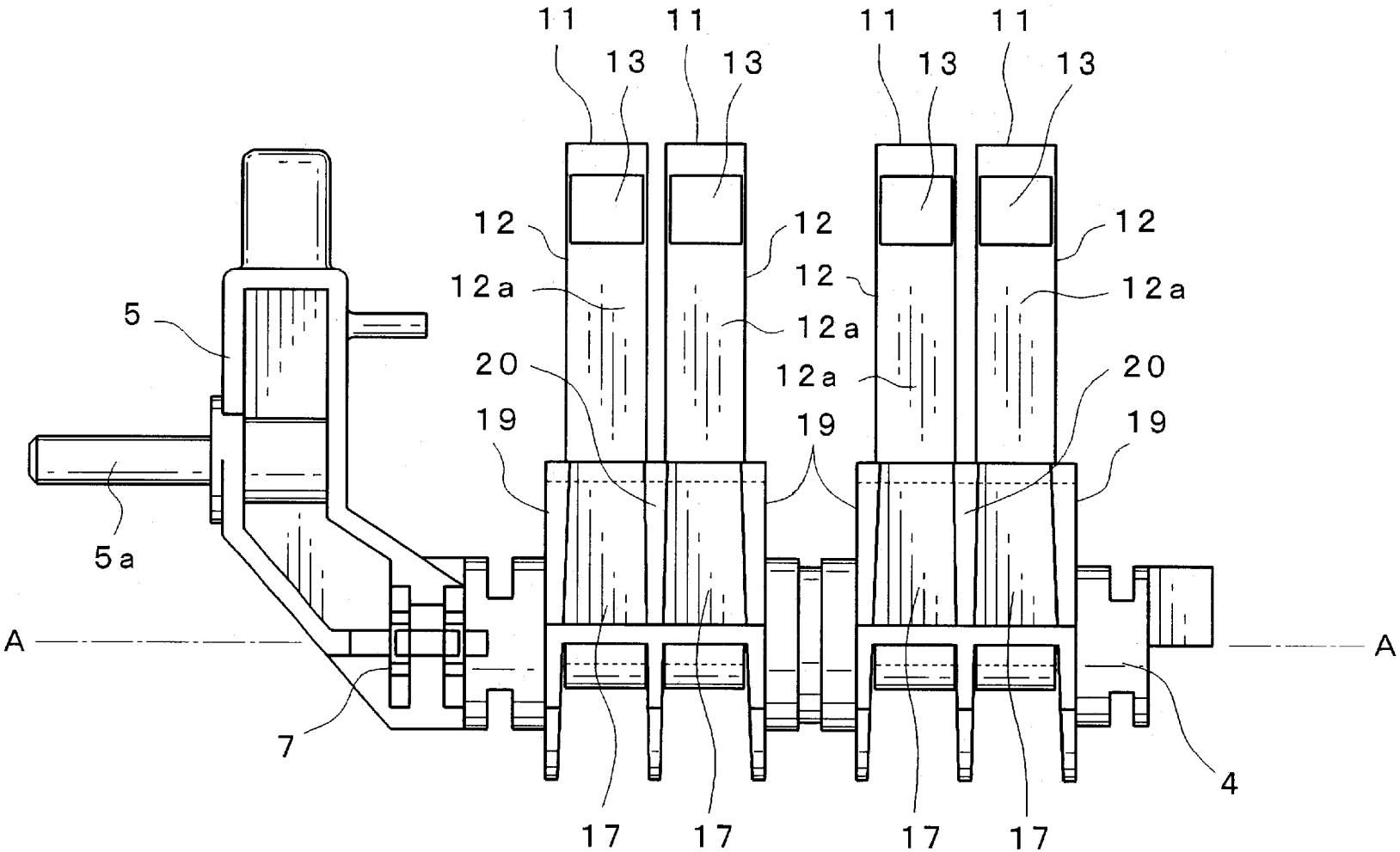
FIG. 6 is a front view of the crossbar associated with moveable contacts.

As shown in FIGS. 2 and 4, the toggle mechanism 3 includes a drive handle 5 and a pair of toggle linkages 6. As shown in FIGS. 4 and 5, each toggle linkage 6 is provided with a link arm 7, an extensible link 8 and a coil spring 9. The drive handle 5 and the link arm 7 of the toggle linkage 6 are both secured to one end of the crossbar 4 in an arrangement rotatable about the longitudinal axis A—A of the crossbar 4.

The drive handle 5 is driven for turning by manual operation or by operation of a proper drive mechanism such as solenoids 10 shown in FIG. 2.

In FIG. 2, a pair of solenoids 10 is secured to the frame 2 in a symmetric arrangement with respect to the longitudinal axis A—A. A plunger 10*a* of each solenoid 10 is coupled to the drive handle 5 via a connector 32 and a rod 5*a*.

Figure 3:
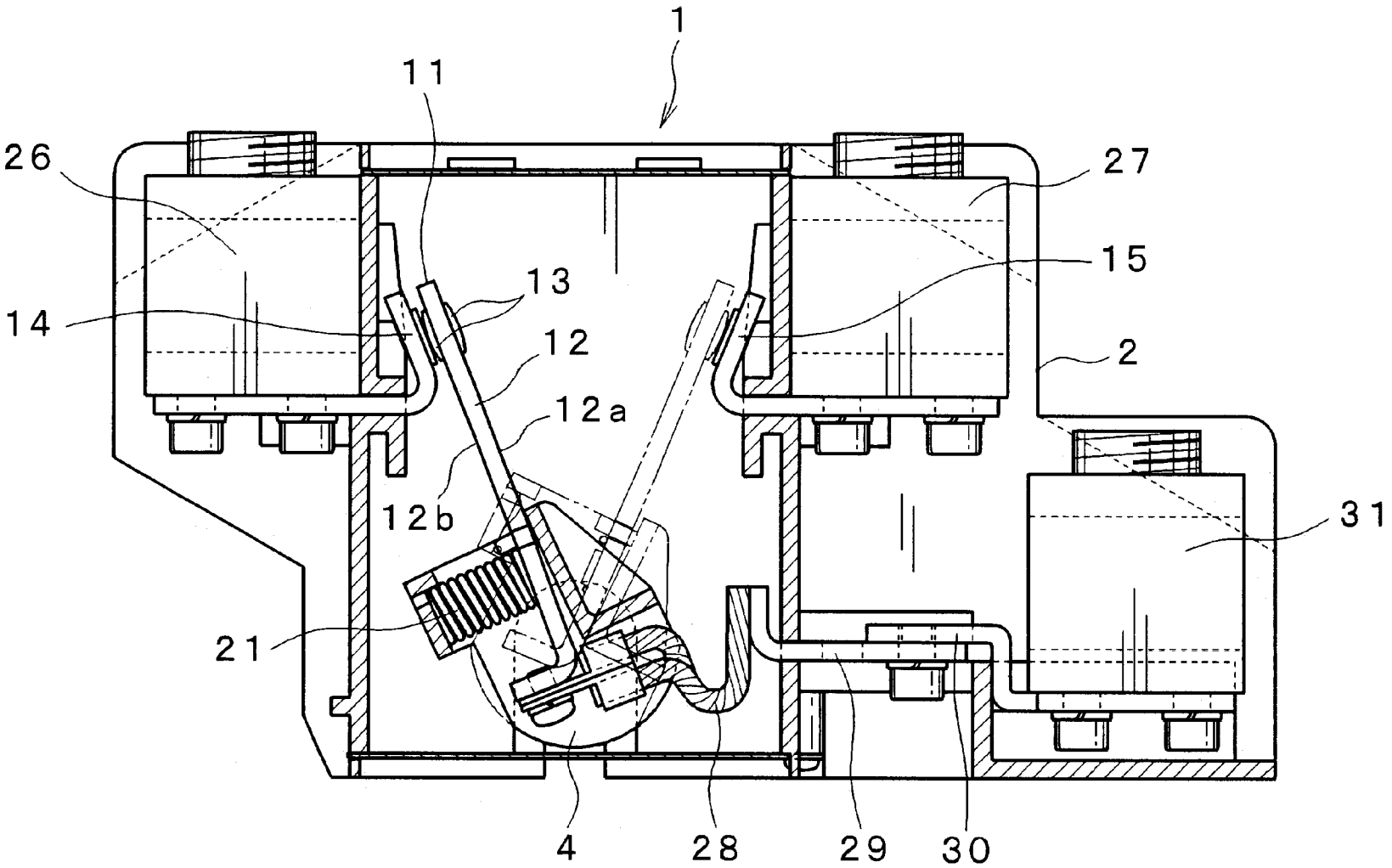
FIG. 3 is a section taken along a line III—III in FIG. 1.

As shown in FIG. 3, a plurality of moveable contacts 11 are carried by the crossbar 4. Each moveable contact 11 is provided with a contact bar 12 and contacts 13 attached to opposite surfaces 12*a* and 12*b* both parallel to the longitudinal axis A—A. As the crossbar 4 rotates, each moveable contact 11 shifts from the first position (shown with solid lines) for contact with the first stationary contact 14 to the second position (shown with imaginary lines) for contact with the second stationary contact 15. The first and second positions are arranged symmetrically with respect to the longitudinal axis A—A and the first and second stationary contacts 14 and 15 are also arranged symmetrically with respect to the longitudinal axis A—A.

Figure 9A:
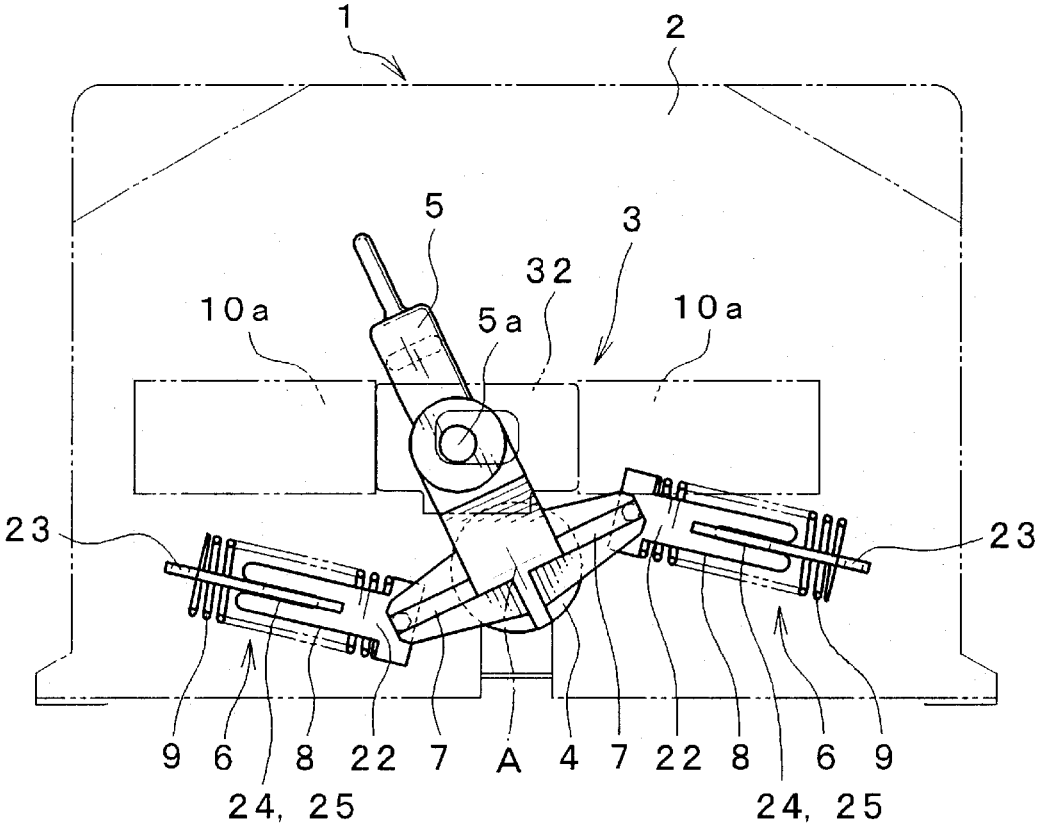
FIG. 9A is a schematic side view of the toggle mechanism registered at the first position.
Figure 9B:
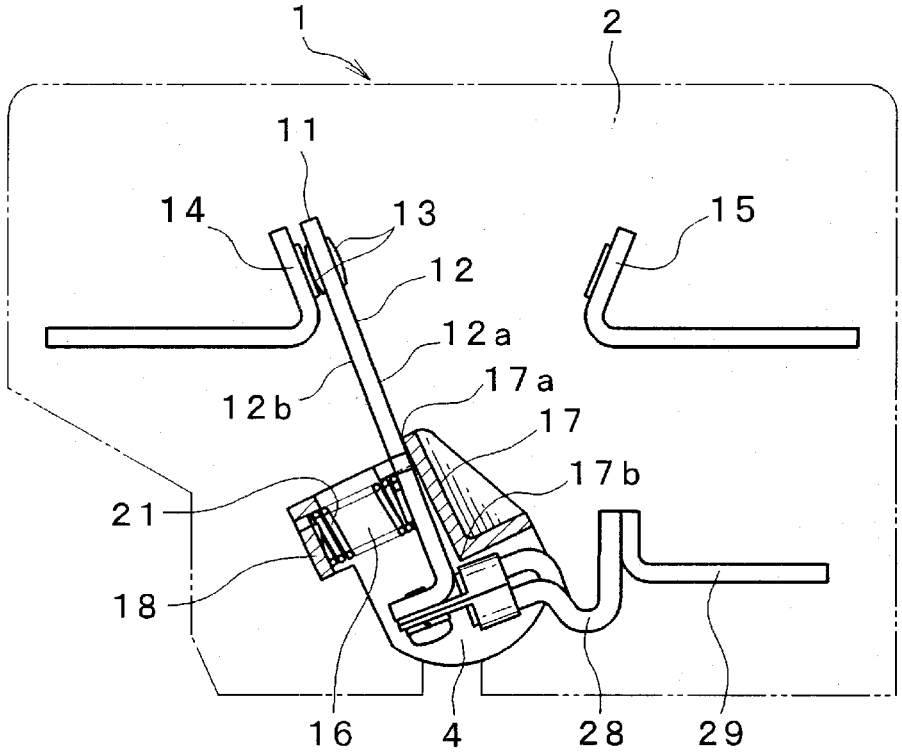
FIG. 9B is a schematic side view of the moveable contact and a stationary contact when the toggle mechanism is at the position shown in FIG. 9A.

In the condition shown in FIG. 9B, the moveable contact 11 is registered at the first closed position so that its contact 13 is placed in contact with the associated stationary contact 14. In the condition shown in FIG. 13B, the moveable contact 11 is registered at the second closed position so that its contact 13 is placed in contact with the stationary contact 15.

As shown in FIG. 3, the stationary contacts 14 and 15 are connected, via terminals 26 and 27, to different power supplies, e.g. one to a normal power supply and the other to an emergency power supply. In the condition shown in FIG. 11B, the moveable contact 11 is registered at a neutral position.

Figure 7:
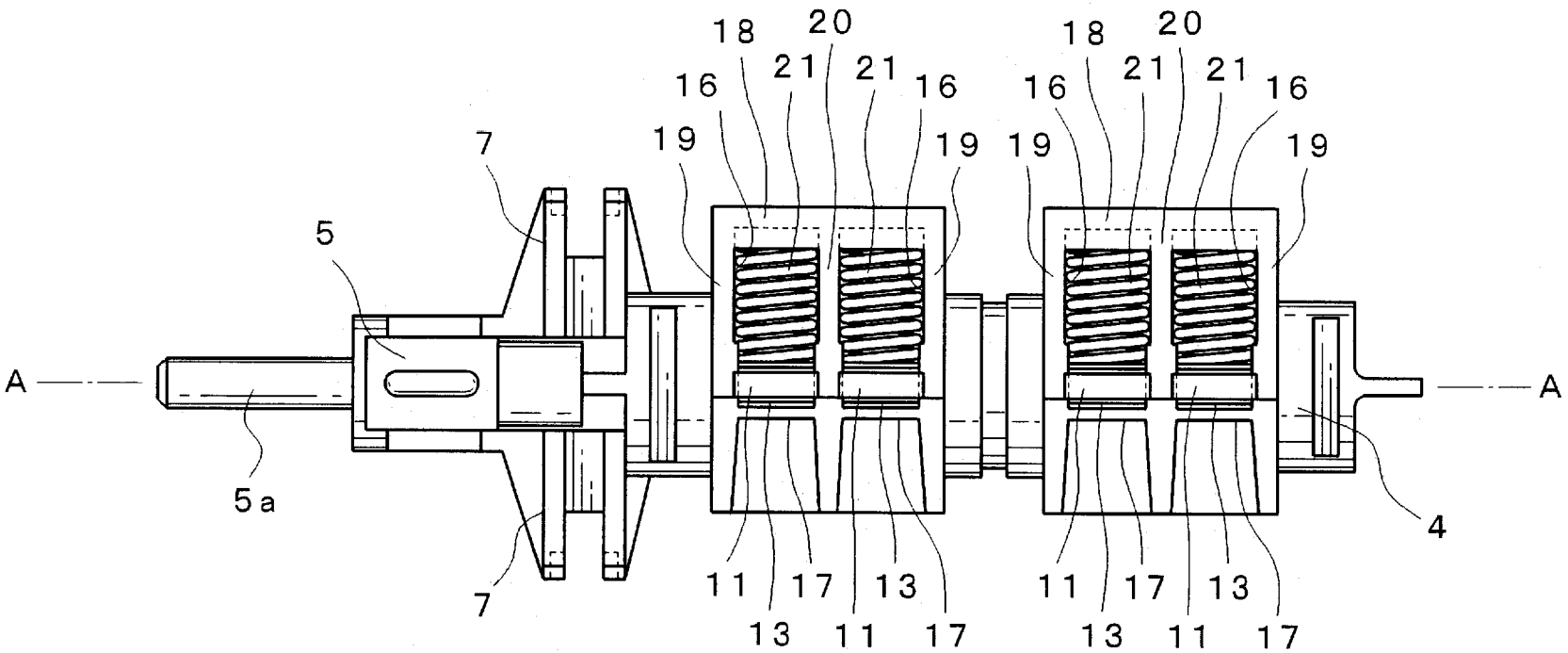
FIG. 7 is a plan view of the crossbar associated with the toggle mechanism and the moveable contacts.
Figure 8:
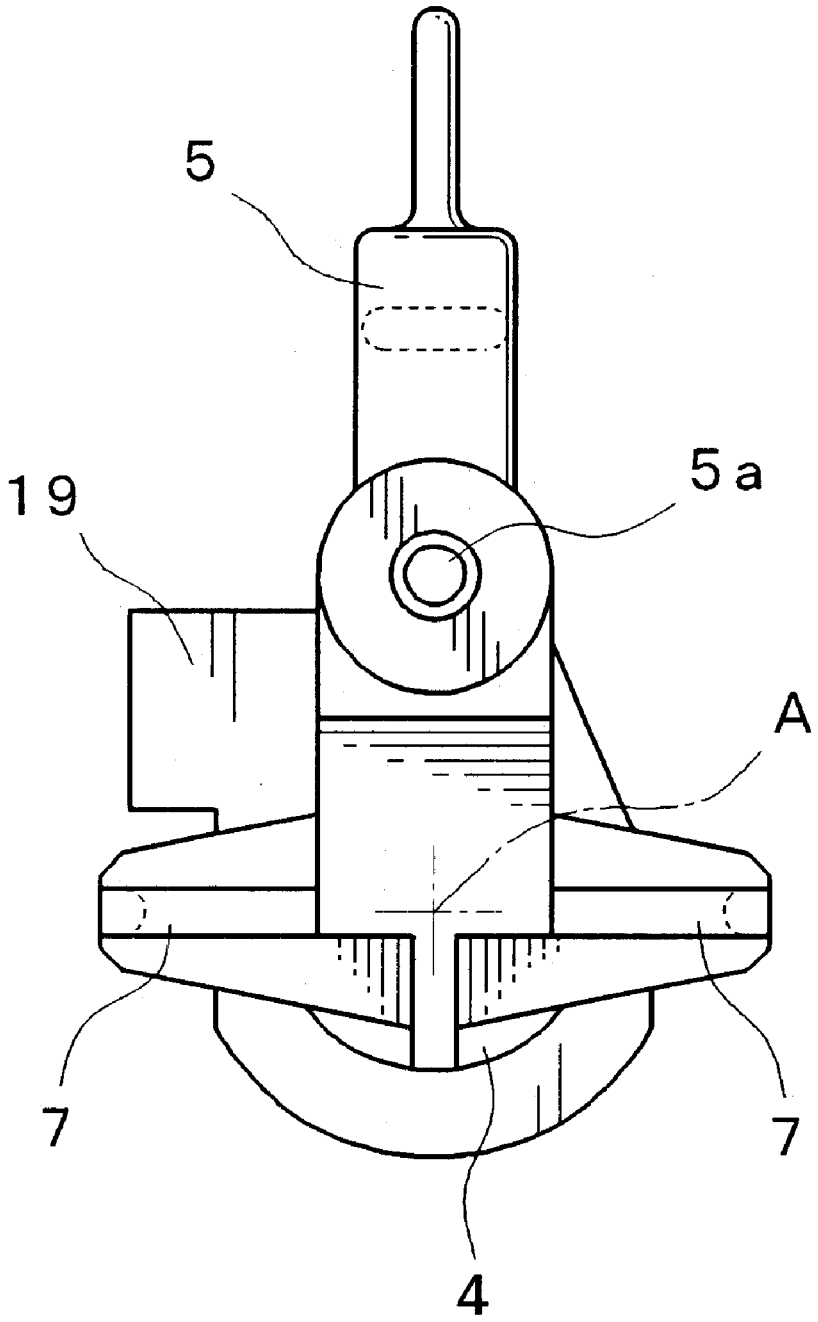
FIG. 8 is a side view of the crossbar associated with the moveable contacts.

As shown in FIGS. 3, 5 and 7, the base portion of the contact bar 12 of the moveable contact 11 is accommodated within a receptive recess 16 formed in the crossbar 4 and, as shown in FIG. 3, connected to various electric loads via conductors 28, 29 and 30 and a terminal 31. The receptive recess 16 is defined by opposite first and second side walls 17 and 18 extending in parallel to the longitudinal axis A—A and opposite third and fourth side walls 19 and 20 extending normal to the longitudinal axis A—A.

The contact bar 12 is accommodated within the receptive recess 16 with its one side surface 12*a* extending in parallel to the first side wall 17. A contact spring 21 is inserted into the receptive recess 16 with its one end in engagement with the side wall 18 and its the other end in engagement with the side surface 12*b* of the contact bar 12.

When the contact bar 12 is closed on the side of the first stationary contact 14 as shown in FIG. 9B, the contact bar 12 tilts about a contact point with the upper end 17*a* of the first side wall 17 so as to lift from the lower end 17*b* of the side wall 17. By this tilting, the contact bar 12 compresses the contact spring 21. As a result, spring force presses the moveable contact 11 against the stationary contact 14.

Figure 13A:
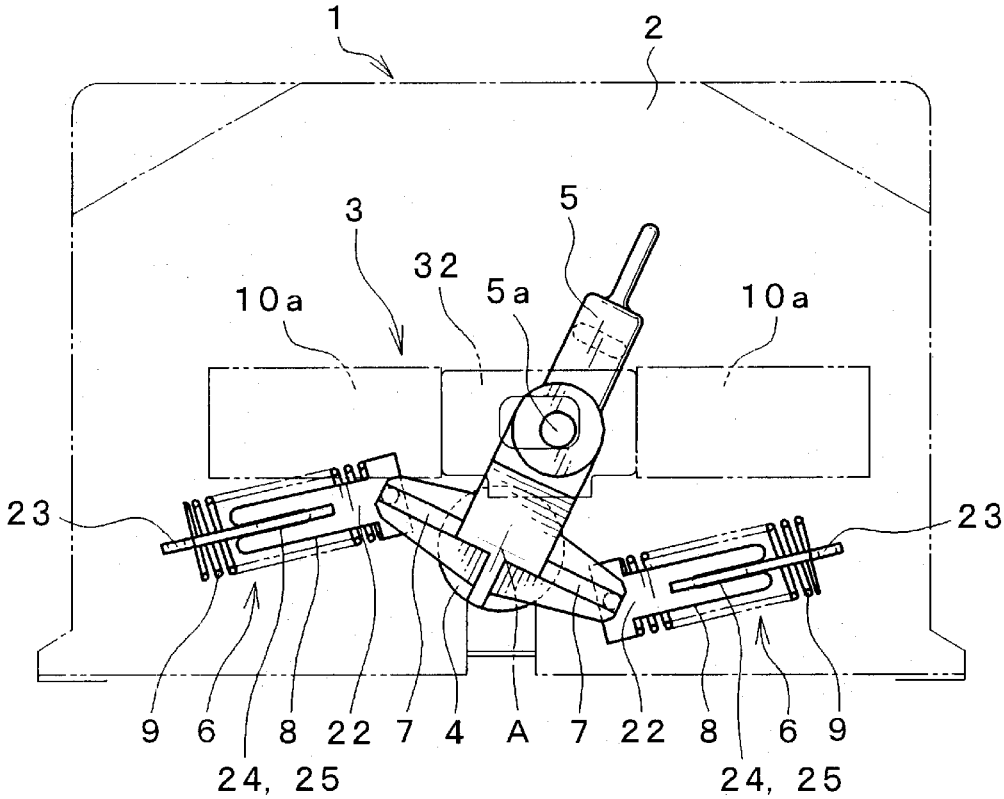
FIG. 13A is a schematic side view of the toggle mechanism registered at the second position.
Figure 13B:
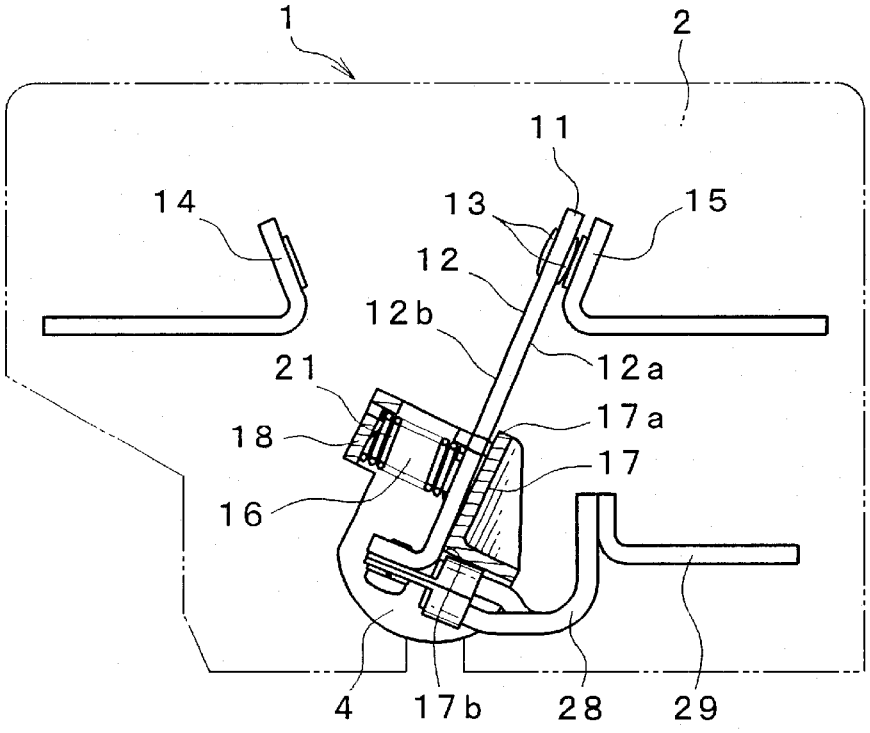
FIG. 13B is a schematic side view of the moveable contact and a stationary contact when the toggle mechanism is at the position shown in FIG. 13A.

When the contact bar 12 is brought into contact with the second stationary contact 15 as shown in FIG. 13B, the contact bar 12 tilts about a contact point with the lower end 17*b* of the side wall 17 so as to lift from the upper end 17*a* of the side wall 17. By this tilting, the contact bar 12 compresses the contact spring 21. As a result, the spring force presses the moveable contact 11 with the stationary contact 15.

Two sets of moveable contacts 11, stationary contacts 14 and 15 are employed in the embodiment shown in FIGS. 1 and 5 to 7. It should be, however, understood that the number of contacts may vary depending on the number of phase of the power supply. A single-phase power supply employs two sets of contacts and a three-phase power supply employs three sets of contacts. Although adjacent two moveable contacts 11 form one set in the case of the illustrated embodiment, only one moveable contact 11 may be used when current-carrying capacity is small.

As shown in FIGS. 4, 5 and 9 to 13, each toggle linkage 6 of the toggle mechanism 3 includes the link-arm 7, the extensible link 8 and the coil spring 9. The pair of link arms 7 extends from one end of the crossbar 4 in a direction traverse the longitudinal axis A—A with symmetry with respect to the longitudinal axis A—A.

Each of the pair of extensible links 8 extends through the associated coil spring 9 and pivoted at one end to the front end of the associated link arm 7 and pivoted at the other end to the frame 2. The pivots to the frame 2 are located symmetric to the longitudinal axis A—A of the crossbar 4. Arrangement of the extensible link 8 within the coil spring 9 enables compactification of the entire switch unit.

Each extensible link 8 includes two link bars 22 and 23 which are coupled to each other in a longitudinally extensible fashion. One link bar 22 is pivoted at one end to the link arm 7 and provided, at the other end, with a slot 24 extending in the longitudinal direction. The other link bar 23 is pivoted, at one end, to the frame 2 and provided, at the other end, with a slot 24 extending in the longitudinal direction. The two link bars 22 and 23 are coupled to each other in a longitudinally extensible fashion through engagement of the slots 24 and 25. Each coil spring 9 urges the associated link bars 22 and 23 in the direction of extension.

As the drive handle 5 is turned clockwise from the closed position shown in FIG. 9A, the extensible link 8 is compressed and the coil spring 9 is also compressed to start to sore mechanical energy. Once the drive handle 5 assumes the neutral closed position shown in FIG. 11A past the position shown in FIG. 10A, the pivots on both ends of the extensible link 8 and the longitudinal axis A—A are located on a common straight line. Concurrently with this process, the link arm 7, the extensible link 8 and the coil spring 9 are also located on the common straight line and the coil spring 9 arrives at its dead center of compression.

When the drive handle 5 is further turned and pivot between the extensible link 8 and the link arm 7 traverses a straight line connecting the pivot on the frame 2 and the longitudinal axis A—A, the mechanical energy stored by the coil spring 9 is released. This release of mechanical energy causes concurrent extension of the extensible link 8 and the drive handle 5 swiftly returns to the closed position shown in FIG. 13A past the position shown in FIG. 12A.

Figure 10A:
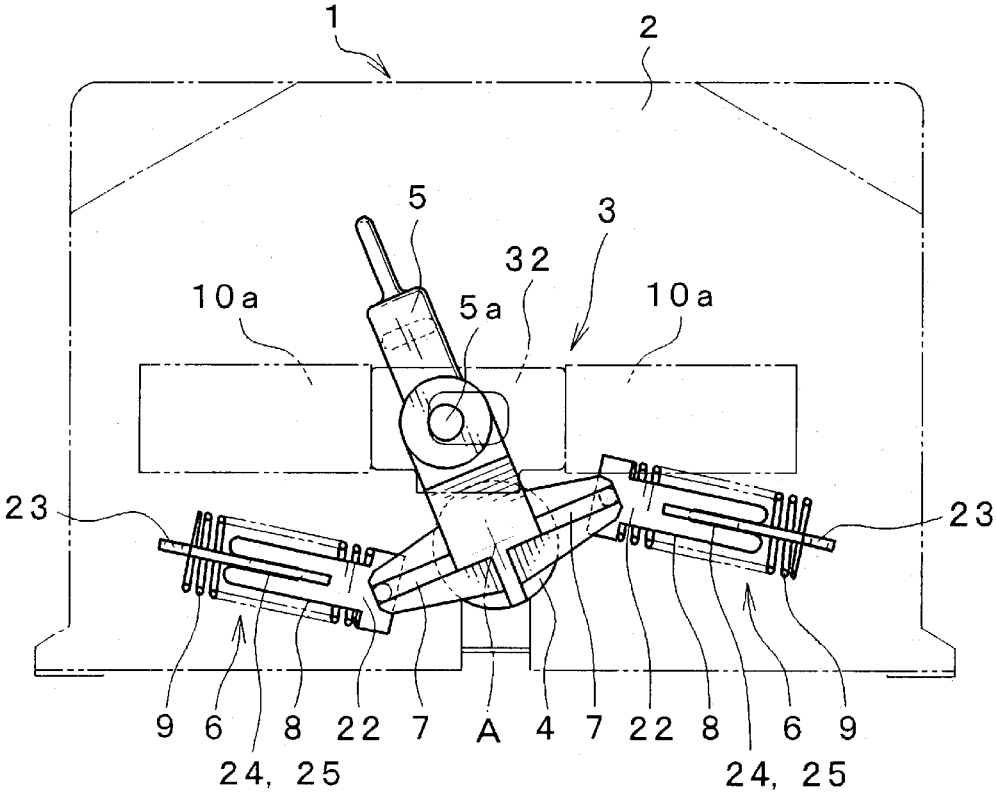
FIGS. 10A is a schematic side view of the toggle mechanisms on a way from the first to third position.
Figure 10B:
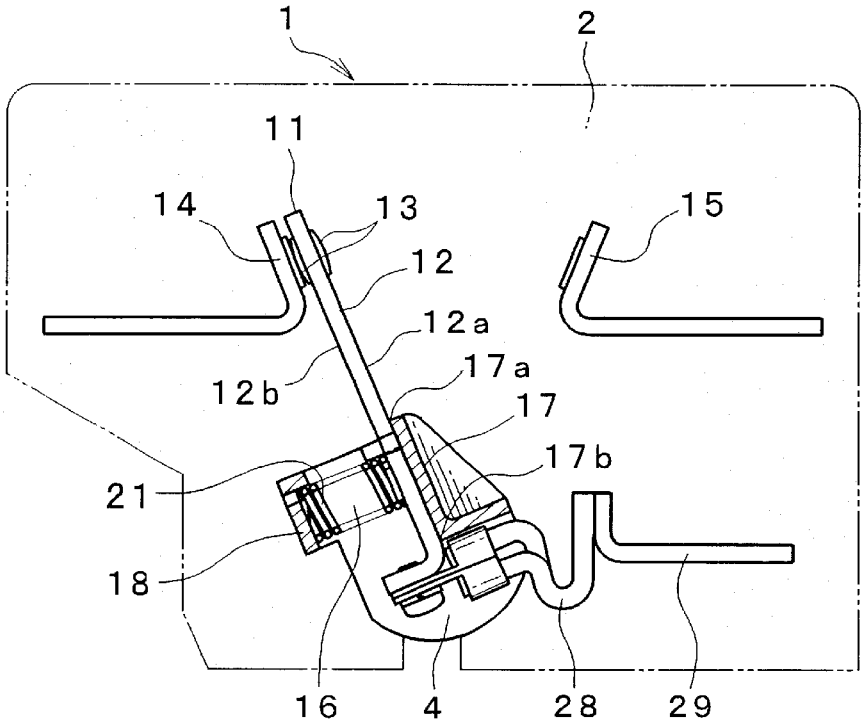
FIG. 10B is a schematic side view of the moveable contact and a stationary contact when the toggle mechanism is at the position shown in FIG. 10A.
Figure 11A:
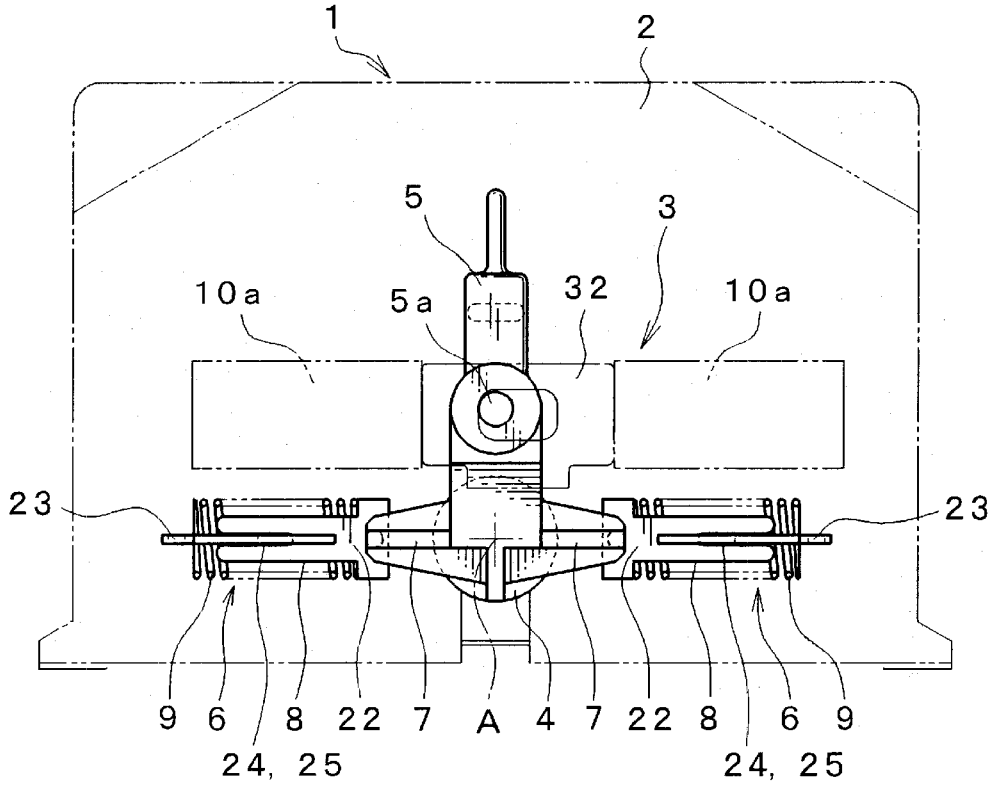
FIG. 11A is a schematic side view of the toggle mechanism registered at the third position.
Figure 11B:
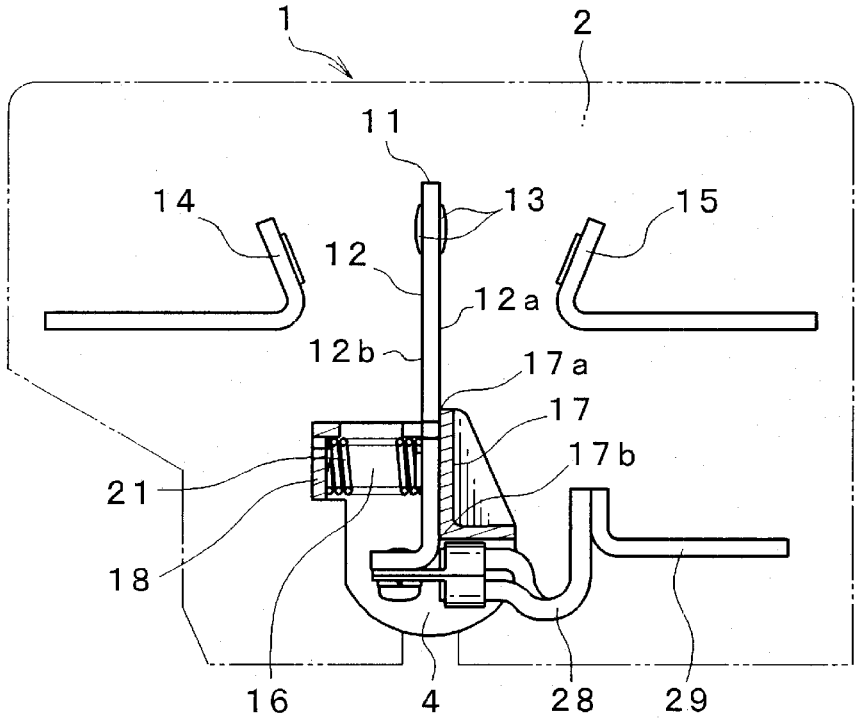
FIG. 11B is a schematic side view of the moveable contact and a stationary contact when the toggle mechanism is at the position shown in FIG. 11A.
Figure 12A:
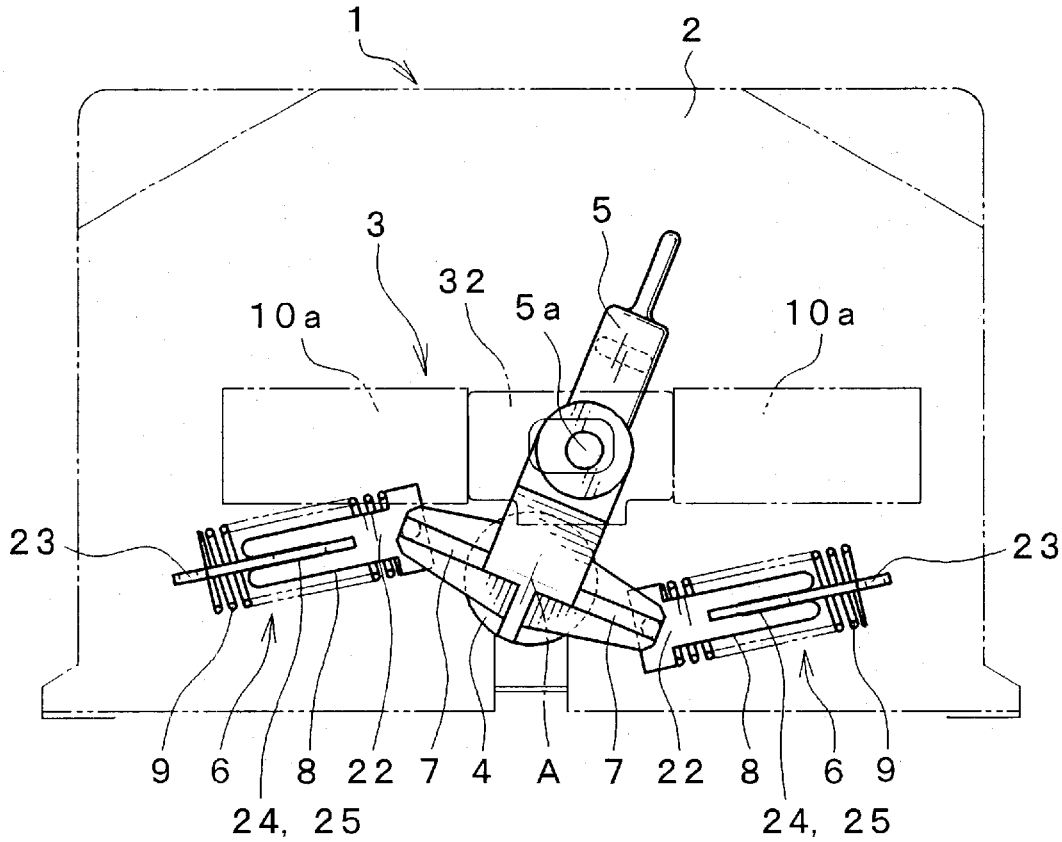
FIG. 12A is a schematic side view of the toggle mechanisms on a way from the third to second position.
Figure 12B:
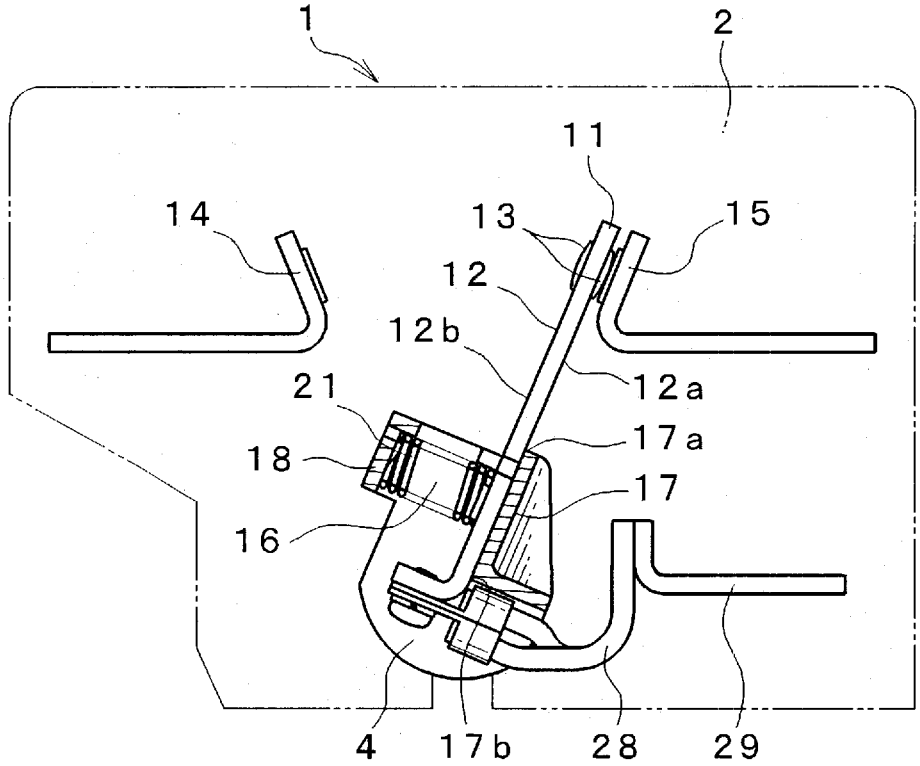
FIG. 12B is a schematic side view of the moveable contact and a stationary contact when the toggle mechanism is at the position shown in FIG. 12A.

During this process, the moveable contact 11 shifts to the closed position shown in FIG. 13B for contact with the other stationary contact 15 past the positions shown in FIGS. 10B, 11B and 12B. At this closed position, the upper portion of the contact bar 12 of the moveable contact 11 lifts about its lower end from the side wall 17 of the crossbar 4. As a consequence, the spring force of the contact spring 21 operates to keep constant pressure contact of the contact 13 of the moveable contact 11 with the stationary contact 15.

When the drive handle 5 is turned counter-clockwise together with the crossbar 4 from the closed position shown in FIG. 13A, the toggle mechanism 3 operates in a mode opposite to the foregoing case of clockwise turning. That is, the drive handle 5 shifts swiftly to the closed position shown in FIG. 9A past the positions shown in FIGS. 12A, 11A and 10A.

During this process, the moveable contact 11 shifts from the closed position for contact with the stationary contact 15 to the closed position for contact with the stationary contact 14 past the positions shown in FIG. 12B, 11B and 10B.

At the closed position shown in FIG. 9B for contact with the stationary contact 14, the contact bar 12 of the moveable contact 11 lifts about its middle portion from the side wall 17 of the crossbar 4. As a consequence, the spring force of the contact spring 21 operates on the contact bar 12 so that the contact 13 of the moveable contact 11 is kept in constant pressure contact with the stationary contact 14. In this way, the moveable contact 11 is brought into pressure contact with respective stationary contact 14 or 15 at the first and second closed positions by the spring force of the single contact spring 21.

In accordance with the present invention, use of a toggle mechanism able to store mechanical energy assures swift and stable shift from one power supply to the other power supply. The transfer switch unit of the present invention is very simple in construction and compact in size with use of reduced number of elements.

What is claimed is:

1. An electric transfer switch unit for selective connection to different power supplies comprising at least one moveable contact, two associated stationary contacts electrically connected to said different power supplies, a turnable drive handle, a toggle mechanism arranged between said drive handle and said moveable contact in order to convert turning of said drive handle into corresponding shift of said moveable contact between two separate closed positions for contact with said stationary contacts, and a spring system incorporated in said toggle mechanism to store mechanical energy when said drive handle is turned in one direction and to release stored mechanical energy when said drive handle is turned in the other direction for shift in closed position.

2. An electric transfer switch unit for selective connection to different power supplies comprising a crossbar mounted to a frame in a rotatable arrangement about its own longitudinal axis, a drive handle secured to said crossbar for shifting between first, second and third positions, link arms secured to said crossbar whilst extending laterally and symmetrically with respect to said longitudinal axis of said crossbar, a pair of extensible links arranged symmetrically with respect to said longitudinal axis, each being pivoted at one end to an associated one of said link arms and, at the other end, to said frame, and a coil spring inserted over each said extensible link, said switch unit shifting from said first to second position past said third position when said drive handle is turned in a first direction and a pivot at said one end of said extensible link traverses, in a first direction, a straight line connecting both ends of said extensible link to said longitudinal axis of said crossbar, and said switch unit shifting from said second to first position past said third position when said drive handle is turned in a second direction opposite to said first direction and said pivot traverses said straight line in a second direction opposite to said first direction.

3. An electric transfer switch unit as claimed in claim 2 in which said extensible link includes two link bars coupled to each other in their longitudinal direction in an extensible arrangement, one link bar is pivoted at one end to said link arm and provided at the other end with a longitudinal slot, the other link bar is pivoted at one end to said frame and provided at the other end with a longitudinal slot, and said link bars are coupled to each other via engagement of said slots in an extensible arrangement.

4. An electric transfer switch unit provided with a toggle mechanism for shifting an electric load to a first position connected to a first power supply, a second position connected to a second power supply and a third position without connection to any power supply, said toggle mechanism being provided with (a) a crossbar mounted to a frame in an arrangement rotatable about its own longitudinal axis, (b) a drive handle secured to said crossbar for shifting said switch unit to said first position, said second position and said third position located between said first and second positions, said three positions being located around said longitudinal axis of said crossbar, (c) link arms secured to said crossbar and extending symmetrically on both sides of said longitudinal axis whilst traversing said longitudinal axis, (d) a pair of extensible links pivoted at one ends to associated link arms and pivoted, at the other ends located symmetric with respect to said longitudinal axis, to said frame, and (e) a coil springs inserted over an associated extensible link for urging said extensible link in a direction of extension, said switch unit shifts from said first position to said second position past said third position when said drive handle is turned in one direction and one pivot of said extensible link traverses a straight line connecting pivots on both ends of said extensible link to said longitudinal axis of said crossbar, and said switch unit shifts from said second position back to said first position past said third position when said handle is turned in the other direction and said one pivot of said extensible link traverses said straight line in an opposite direction.

5. An electric transfer switch unit as claimed in claim 4 in which said extensible link includes two link bars longitudinally connected to each other for free extension, one link bar is pivoted at one end to link arm and provided, at the other end, with a longitudinal slot, the other link bar is pivoted at one end to said frame and provided, at the other end, with a longitudinal slot, and said two link bars are connected to each other for free extension through engagement of said slots.

6. An electric transfer switch unit as claimed in claim 4 in which a first stationary contact is located at said first position, secured to said frame and connected to said first power supply, a second stationary contact is located at said second position, secured to said frame and connected to said second power supply, and a moveable contact is mounted on said crossbar and connected to a given electric load in a manner such that said moveable contact comes in contact with said first stationary contact when said drive handle shifts said toggle mechanism from said first position to said second position, and comes in contact with said second stationary contact when drive handle shifts said toggle mechanism from said second position to said first position.

7. An electric transfer switch unit as claimed in claim 6 in which a contact spring is interposed between each said moveable contact and said crossbar in order to keep pressure contact of said moveable contact with one of said first and second stationary contacts.

8. An electric transfer switch unit as claimed in claim 7 in which each said moveable contact is provided with a contact bar extending normal to said longitudinal axis of said crossbar, said crossbar is provided with a receptive recess to swingably accommodate one end of said contact bar, said contact spring is inserted into said receptive recess and in contact at one end with said contact bar in order to urge said contact bar within said receptive recess.

9. An electric transfer switch unit as claimed in claim 8 in which each said moveable contact includes a contact bar extending normal to said longitudinal axis of said crossbar, said receptive recess in said crossbar is defined by opposite first and second side walls arranged in parallel to said longitudinal axis of said crossbar and opposite third and fourth side walls arranged normal to said longitudinal axis of said crossbar, said contact bar is arranged within said receptive recess in said crossbar with its one side surface extending along said first side wall of said receptive recess in an arrangement such that said contact bar tilts about a point of contact with a first end of said first side wall close to said longitudinal axis of said crossbar so as to lift from a second end of said first side wall remote from said longitudinal axis of said crossbar when said contact bar comes into contact with said first stationary contact, said contact bar tilts about a point of contact with a second end of said first side wall so as to lift from said first end of said first side wall when said contact bar comes into contact with said second stationary contact, and said contact spring is interposed between said second side wall of said receptive recess in said crossbar and the other side surface of said contact bar so as to keep pressure contact of said contact bar with said first side wall of said receptive recess so that said contact bar is urged by spring force for pressure contact with said stationary contact when said contact bar is brought into contact with one of said first and second stationary contacts.

10. An electric transfer switch unit as claimed in claim 6 in which said drive handle is associated with means for driving said drive handle for opposite turnings.

11. An electric transfer switch unit as claimed in claim 10 in which said driving means is of an electromagnetic type.

12. An electric transfer switch unit as claimed in claim 10 in which said driving means includes a pair of solenoids secured to said frame, and each said solenoid is provided with a plunger coupled to said drive handle for turning of said drive handle in a selected direction.

13. An electric transfer switch unit as claimed in claim 6 in which said frame is made of non-conductive synthetic resin and provided with a chamber which is defined by four side walls surrounding each said moveable contact and associate first and second stationary contacts.

* * * * *